US005095924A

United States Patent [19]

Stanfield

[11] Patent Number: 5,095,924

[45] Date of Patent: Mar. 17, 1992

[54] PERSONAL TOILETRY CASE

[76] Inventor: John Stanfield, 425 Riverhill Dr., Atlanta, Ga. 30328

[21] Appl. No.: 743,707

[22] Filed: Aug. 12, 1991

[51] Int. Cl.[5] ..... A45D 27/22

[52] U.S. Cl. ..... 132/315; 132/310; 206/228; 206/581

[58] Field of Search ..... 132/286, 309, 308, 310, 132/312, 315, 290, 295; 206/581, 223, 228, 38, 362.1, 15.2; 220/4.22

[56] References Cited

U.S. PATENT DOCUMENTS

| | | | |
|---|---|---|---|
| 1,493,097 | 5/1924 | Blood | 132/315 |
| 1,684,091 | 9/1928 | Halk | 132/315 |
| 1,999,328 | 4/1935 | Lessard | 132/315 |
| 2,168,073 | 8/1939 | Schnider | 132/315 |
| 2,297,984 | 10/1942 | Reller | 132/315 |
| 3,206,012 | 9/1965 | Braginetz | 206/228 |
| 3,315,796 | 4/1967 | Dreyfuss | 206/228 |
| 3,504,787 | 4/1970 | Brockway | 206/38 |
| 4,369,883 | 1/1983 | Stravitz | 220/4.22 |

FOREIGN PATENT DOCUMENTS

| | | | |
|---|---|---|---|
| 1159565 | 6/1958 | France | 132/315 |

*Primary Examiner*—John G. Weiss
*Assistant Examiner*—Michael Lynch
*Attorney, Agent, or Firm*—Kennedy & Kennedy

[57] ABSTRACT

A person toiletry case 10 has a left section 11 and a right section 12 hinged together by hinges 13. Each section has a rectangular side panel 14 bounded by a bottom wall 15, a top wall 16, 16' and two side walls 17. The top walls 16, 16' each have a recessed portion 22, 25 through which articles contained within the case may be accessed. Brackets 26, 29, 30, 31, and 33, extending from the panels 14 of the case, are provided to hold toiletry articles within the case. The case also has venting holes 18 to allow moisture within the case to escape to ambience.

7 Claims, 3 Drawing Sheets

PERSONAL TOILETRY CASE

TECHNICAL FIELD

This invention relates generally to cases, and particularly to cases for use in storing and carrying personal toiletry articles.

BACKGROUND OF THE INVENTION

It is common for travelers to carry toiletry articles, such as razors, mouthwash and dental care products, within a case for ease of transportation and storage. Probably the most popular type of carrying case is that commonly referred to as a "doc kit", which typically are small flexible bags with zippers. While these types of cases provide ample room for carrying articles, they neither separate the articles from each other nor hold them firmly in place within the case. Therefore, as the case is moved about, the articles within it may collide with each other and be impacted by objects outside the kit causing article breakage and soiling.

Toiletry cases have also been made which fix the position of at least some of articles, such as tooth brushes, within the case. Exemplary of this type of case are those shown in U.S. Pat. Nos. 1,670,177, 1,722,507, 2,146,657, 2,353,932, 2,593,896, 3,921,649 and 4,979,525. Although these cases fix the position of the tooth brush, the bristles of the brush still contact the inside of the case, thus making the brush less sanitary. As the tooth brushes are also mostly sealed from ambience, moisture tends to remain on their bristles, further contributing to unsanitary conditions. Another problem commonly associated with these cases is their inadequate accessibility to the contained articles. Indeed, often the case must be partially disassembled to access the encased articles. With others, particularly the folding types, the articles are accessible only after the case has been unfolded over an area much larger than the case itself.

It thus is seen that a need remains for a personal toiletry case in which articles may be held securely in place in a sanitary condition during storage and transportation and yet easily accessed and removed for use. Accordingly, it is to the provision of such a case that the present invention is primarily directed.

SUMMARY OF THE INVENTION

In a preferred form of the invention, a personal toiletry case comprises two sections each having a side panel bounded by a bottom wall of a selected width, two side walls, and a top wall at least a portion of which has a width greater than the bottom wall width. The top wall extends partially between the side walls and generally parallel to the bottom wall. The sections are hinged to each other along adjacent side walls for movement between a case closed configuration with the edges of the bottom and side walls of the sections in abutment, and a case open configuration. The top walls are located between the side panels at different positions relative to the adjacent side walls. With this construction the top walls may be fitted together side by side in the case closed configuration. The case also has article holding means for releasably holding an article within the case to the side panels of the sections at a position below and aside the top walls for easy manual access.

DETAILED DESCRIPTION

Figure 1:
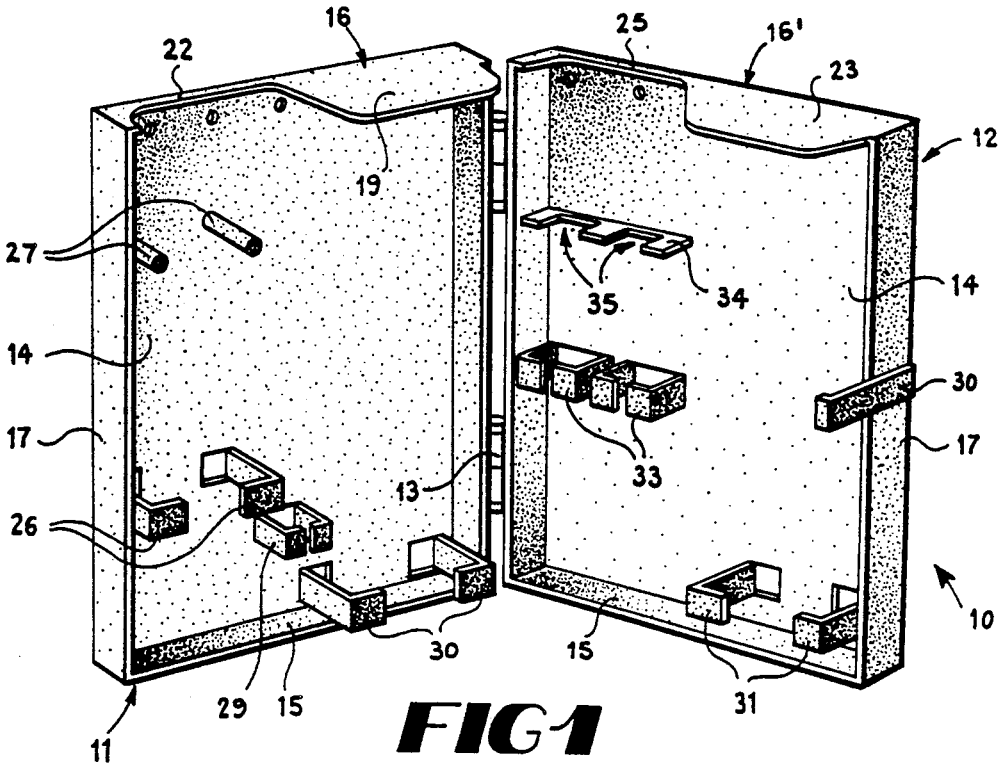
FIG. 1 is a perspective view of a personal toiletry case embodying principles of the invention in its preferred form shown in an open configuration revealing its interior structure.

With reference next to the drawings, there is shown a personal toiletry case 10 having a left section 11 and a right section 12 hingedly to each other by hinges 13. Each section has a rectangular side panel 14 bounded by a bottom wall 15, a top wall 16, 16' and two side walls 17. Each panel has a set of vent holes 18 located near its top. The bottom wall 15 and the end walls 17 are equal in width here.

Figure 2:
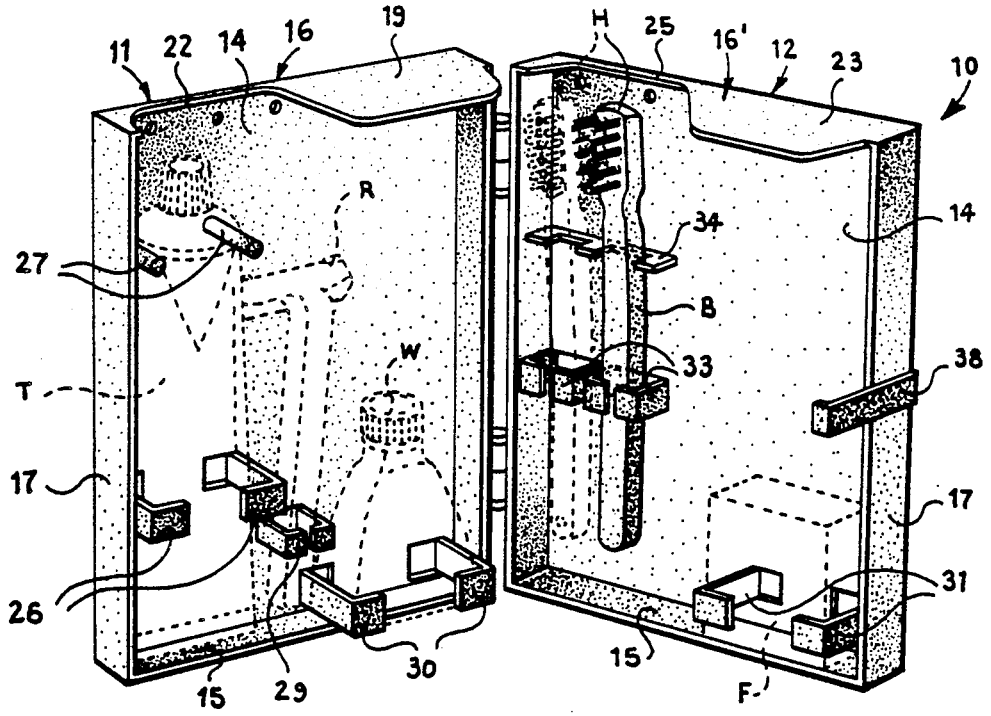
FIG. 2 is a perspective view of the personal toiletry case of FIG. 1 shown with a tooth brush mounted therein and with other personal toiletry articles shown mounted therein in phantom lines.
Figure 3:
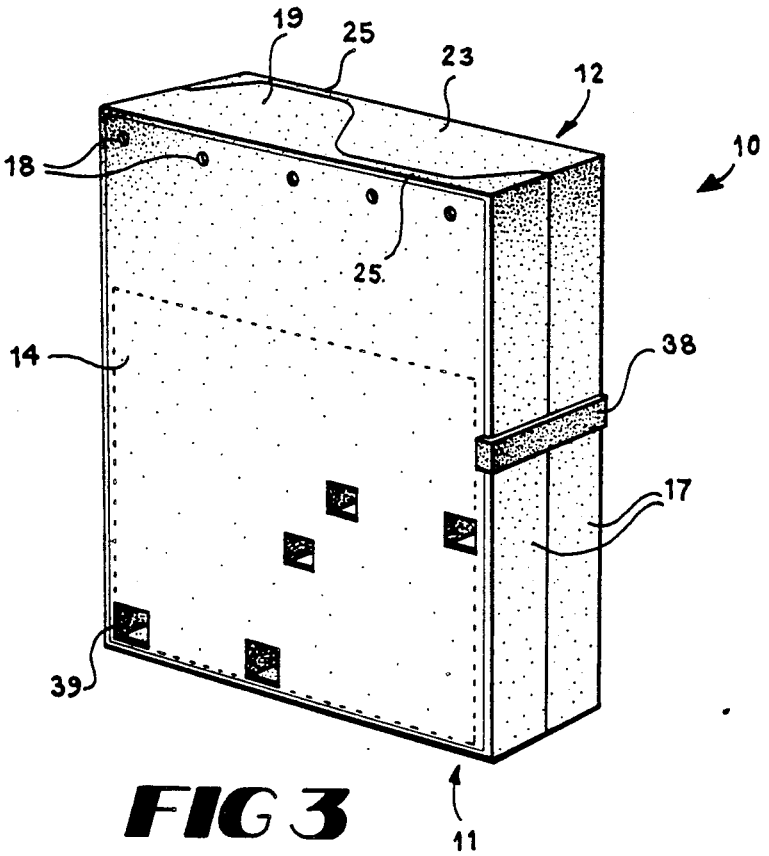
FIG. 3 is a perspective view of the personal toiletry case of FIG. 1 shown in a closed configuration.
Figure 4:
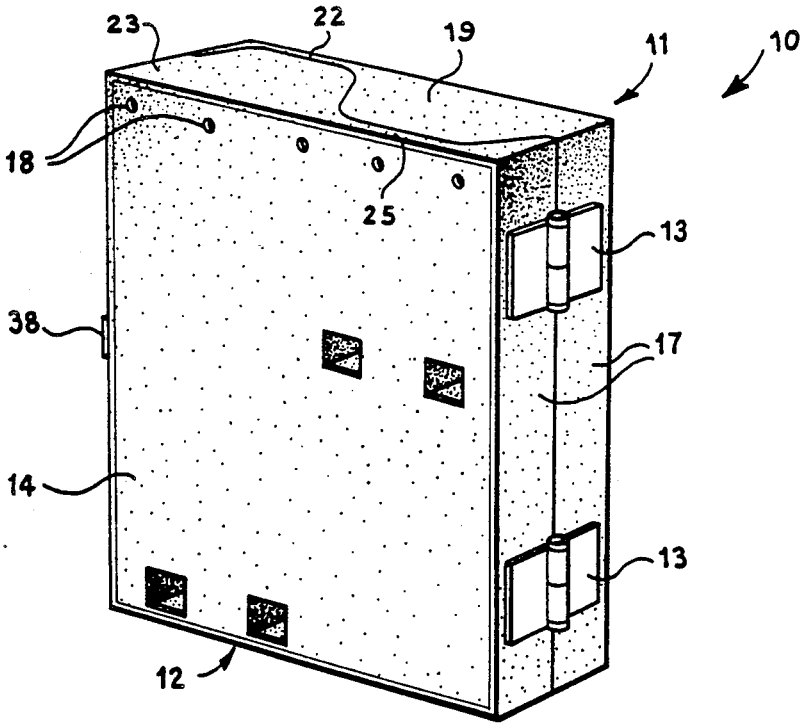
FIG. 4 is a perspective view of the opposite side of the personal toiletry case to that shown in FIG. 3.
Figure 5:
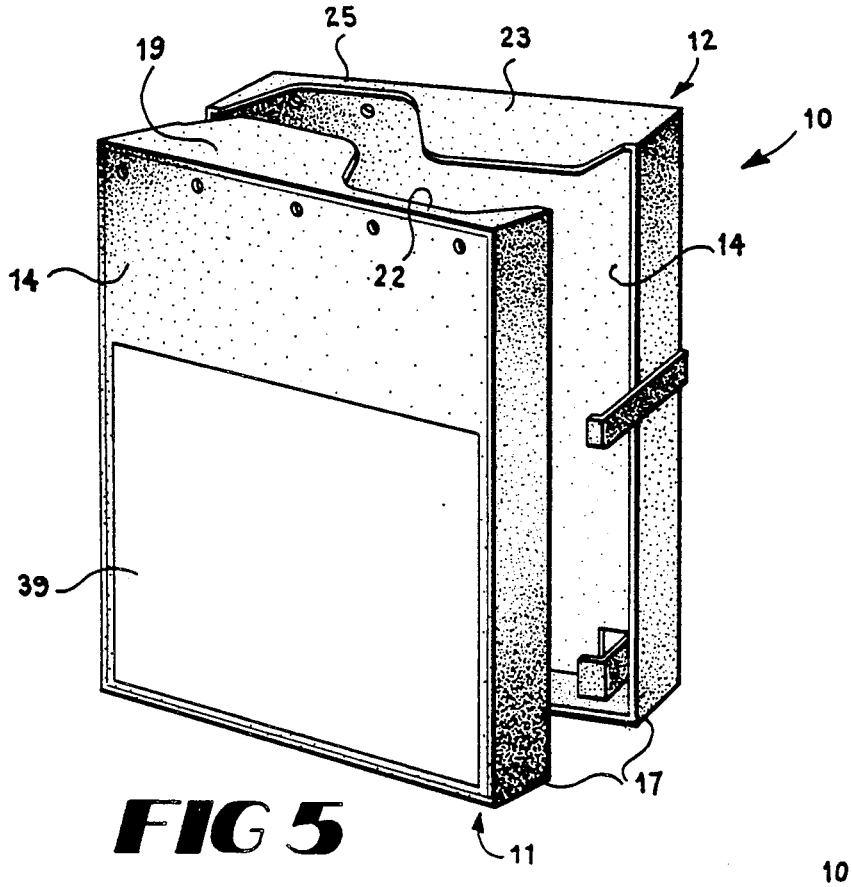
FIG. 5 is a perspective view of the personal toiletry case of FIG. 1 shown in a slightly open configuration.

The top wall 16 of the left section 11 is formed with an extended portion 19 located proximally to a side wall to which the hinges 13 are mounted which has a width greater than that of the bottom wall so that it extends beyond the bottom and end walls of the section. This top wall also has a recessed portion 22 located distally from the hinged side wall which has a width less than that of the bottom and side walls of section 11. Conversely, the top wall 16' of the right section 12 is formed with an extended portion 23 located distally from its hinged side wall which has a width greater than that of the bottom wall so that it extends beyond the bottom and end walls. This top wall also has a recessed portion 25 located adjacent the hinged side wall which has a width less than that of the bottom wall and end walls. In this manner, the walls of the left and right sections are configured such that an enclosed case is formed when the sections are pivoted together, as shown in FIG. 3. However, when pivoted to an open configuration, as shown in FIGS. 1 and 2, the extended portions of their top walls extend over and hood different areas of the panels 14 with respect to their proximity to the hinged side walls.

A pair of brackets 26 and a pair of posts 27 extend from the interior of the panel of the left section 11 directly below the recessed portion 22 of top wall 16. These brackets 26 and posts 27 are configured and aligned to hold a conventional tube of toothpaste T. Another bracket 29 extends from the interior of the panel of the left section 11 configured to hold a razor R. Another pair of brackets 30 extend from the interior of this panel configured to hold a bottle of mouthwash W of conventional size and shape. Similarly, brackets 31 extend from the interior of the panel of the right section 12 configured to hold a box of dental floss F. A pair of brackets 33 extend from the interior of the panel of the right section directly below recessed portion 25 of top wall 16'. A bar 34 having a pair of recesses 35 also extends from the interior of the panel above brackets 33. The brackets 33 and bar recesses 35 are configured to hold a pair of conventional toothbrushes B in a slightly arched condition so that the bristles of the toothbrush are flexed outwardly from the panel. Finally, the case is provided with a resilient catch 38 to releasably hold the two sections closed.

For use, a tube of tooth paste T, a razor R, a bottle of mouthwash W, a box of dental floss F and a pair of tooth brushes B may be mounted within the case and held securely in place by the several brackets. Each of these articles here has a thickness such that it is compatible with the articles and brackets of the opposite section, i.e. so as not to interfere with each other in a case closed configuration. The tooth brushes are held in position with their handles extending through and firmly, but releasably, held by the brackets 33 and 34 with the head H of each brush. The bar 34 extend from the panel 14 a short distance which causes the head H to arch away from the panel, as shown in FIG. 2. The outward flexing of the heads H prevents them from contacting and becoming soiled by the panel. To enable the case to be as small or shallow as possible, in a closed position, the tooth brush holding brackets 33 are positioned upon the panel so as to extend above the bottle of mouthwash W. Similarly, tooth paste holding brackets 26 are positioned upon the panel so as to extend above the box of dental floss F. In this manner, neither the brackets nor their articles occupy the same space as another bracket or article and when closed those brackets extending over mouthwash W and dental floss F prevent those items from moving even if the case is turned upside down.

An important feature of the case is that it may be positioned for use upon a support, such as a small bathroom basin, to provide easy access to articles contained within the case. As shown in FIG. 2, the case may be used in an upright orientation which minimizes the space necessary to support the case. With it in an open position, the unique configuration of its top walls provides easy manual access to the relatively long toothbrushes since they are only hooded by the recessed portion of the top wall of section 12. Thus one may reach for the article from above and beside the top wall of the section to which the article is mounted. Similarly, the relatively long tube of paste T may be easily accessed since it is hooded only the recessed portion of the top wall of section 11.

To allow moisture on the encased articles to evaporate rapidly into ambient air, the case is provided with vent holes 18. This is also important, for moisture promotes the growth of bacteria which could breed within the case should it remain stagnant.

Figure 6:
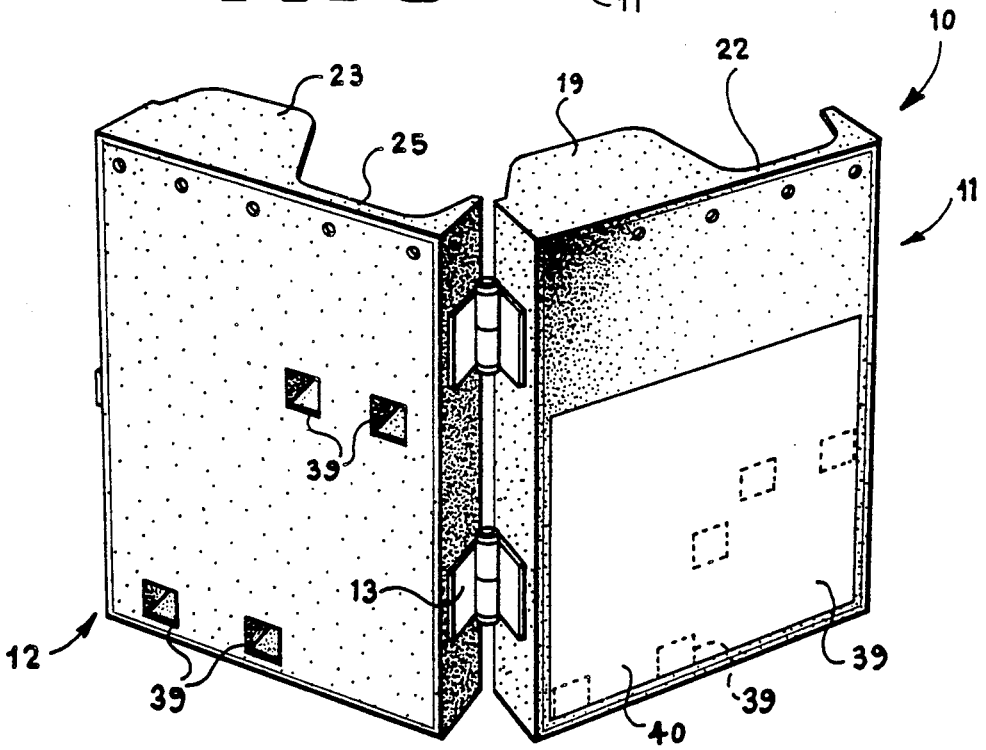
FIG. 6 is a perspective view of the opposite side of the personal toiletry case to that shown in FIGS. 1 and 2 in an open configuration.

The case 10 is preferably produced by injection molding. This process, in forming the brackets, produces openings 39 in the panels 14. If desired these openings may be covered by mounting a decorative or instruction overlay 40 to the panel, as best shown in FIG. 6.

The top wall of each section of the case just described has an extended and a received portion. However, the top walls may have only the extended portion. Also, though both case sections preferably have side and bottom walls, only one section need have such. Although the case is specially designed for use with toiletry articles, its principles may, of course, be used with cases in which other types of articles are housed.

From the foregoing, it is seen that a case for carrying personal toiletry is now provided which overcomes problems long associated with those of the prior art. It should however be understood that the just described embodiment merely illustrates principles of the invention in its preferred form. Many modifications, additions and deletions may, or course, be made thereto without departure from the spirit and scope of the invention as set forth in the following claims.

I claim:

1. A personal toiletry case comprising two sections each having a side panel bounded by a bottom wall of a selected width, two side walls, and a top wall at least a portion of which has a width greater than said bottom wall selected width that extends partially between said side walls generally parallel to said bottom wall, said two sections being hinged to each other along adjacent side walls for movement between a case open configuration and a case closed configuration with said bottom and side walls of said two sections in abutment, and wherein said top wall portion of said two sections are located at different positions relative to said adjacent side walls whereby they may be fitted together with each other side by side in said case closed configuration, and article holding means mounted to each of said side panels or releasably holding articles within said case to said side panels at positions below and aside each of said top wall portion.

2. The personal toiletry case of claim 1 wherein said top wall of each of said two sections has another portion that has a width less than said selected width of said bottom wall.

3. The personal toiletry case of claim 2 further comprising vent means for venting the interior of said case to ambience.

4. The personal toiletry case of claim 1 wherein said bottom walls are generally flat so that said case may stand erect upon said bottom walls.

5. The personal toiletry case of claim 1 wherein said top walls are configured substantially the same.

6. The personal toiletry case of claim 1 wherein said article holding means is adapted to hold a toothbrush uprightly with the bristle portion of the toothbrush flexed outwardly from said side panel.

7. In a personal toiletry case of the type having two sections hinged together along two adjacent sides for movement between case open and case closed configurations, the improvement comprising one of said sections having a bottom wall of a selected width and a top wall portion having a width greater than said bottom wall selected width located proximally to its adjacent side and the other of said sections having a bottom wall of a selected width and a top wall portion having a width greater than said bottom wall selected width located distally from its adjacent side configured to mesh side by side with said top wall portion of said one section in a case closed configuration, and with each of said sections having article retention means mounted below and to one side of said top wall portion of each said sections whereby access to an article retained by an article retention means of either section may be had by passing fingers aside the top wall portion of the section in a case open configuration and article retained by the article retention means compactly side by side in a case closed configuration.

* * * * *